US006368296B1

(12) United States Patent
Eiter et al.

(10) Patent No.: US 6,368,296 B1
(45) Date of Patent: Apr. 9, 2002

(54) BELT APPARATUS FOR HUMAN PELVIS

(75) Inventors: Frank J. Eiter, Morganfield, KY (US); Sidney P. Nelson, Griffin, IN (US)

(73) Assignee: Daniel T. Cassidy, San Diego, CA (US)

( * ) Notice: Subject to any disclaimer, the term of this patent is extended or adjusted under 35 U.S.C. 154(b) by 0 days.

(21) Appl. No.: 09/662,046

(22) Filed: Sep. 15, 2000

Related U.S. Application Data

(60) Provisional application No. 60/154,642, filed on Sep. 17, 1999.

(51) Int. Cl.[7] ..... A61F 5/00
(52) U.S. Cl. ..... 602/19; 482/146
(58) Field of Search ..... 602/5, 19, 32; 128/846, 869, 876, 96.1; 482/9, 130, 146

(56) References Cited

U.S. PATENT DOCUMENTS 5,651,764 A * 7/1997 Chiu ..... 602/38
5,913,410 A * 6/1999 Tsuchiya ..... 602/19
5,941,807 A * 8/1999 Cassidy ..... 482/146

* cited by examiner

*Primary Examiner*—Michael A. Brown
(74) *Attorney, Agent, or Firm*—Jason H. Foster; Kremblas, Foster, Phillips & Pollick

(57) ABSTRACT

A pelvic belt is described for firmly gripping a human torso near the pelvic region. The pelvic belt includes three main components: a U-shaped frame with left and right frame legs, a left arm assembly pivotably mounted to the left frame leg, and a right arm assembly pivotably mounted to the right frame leg. Each arm assembly has four main sub-components: an upper arm, a lower arm, a connecting rod connecting the upper and lower arms rigidly together and an adjustment wing for adjusting the dimensions of the interior region of the pelvic belt. The left and right arm assemblies pivot about pivot pins mounting the arm assemblies to the U-shaped frame. This permits a person to enter the interior region of the pelvic belt when the arm assemblies are pivoted open, and then the arm assemblies are pivoted to a closed position. The pelvic belt can be attached to force resisting mechanisms to build strength over time.

2 Claims, 5 Drawing Sheets

BELT APPARATUS FOR HUMAN PELVIS

This application claims the benefit of U.S. Provisional Application No. 60/154,642, filed Sep. 17, 1999.

BACKGROUND OF THE INVENTION

1. Field of the Invention

The invention relates generally to exercise and rehabilitation equipment, and specifically to a pelvic belt into which a human torso, near the pelvic region, is inserted and firmly retained for connecting it to the exercise and rehabilitation equipment.

2. Description of the Related Art

The human torso has many muscles that are oriented at various angles from their attachment to the pelvis. In order to exercise these muscles, or assist in rehabilitation of injured muscles, it is necessary to use a machine like that shown in my U.S. Pat. No. 5,941,807 for a Torso Muscle And Spine Exercise Apparatus, which is incorporated by reference. This machine uses rotating resistance to strengthen torso muscles.

When a person wishes to use the Torso Muscle And Spine Exercise Apparatus, he must first firmly attach the belt to his pelvic region. Cables extend from different points on the belt to a weight stack. The person rotates his pelvic region relative to other parts of the body is against the resistance created by lifting the weights in the weight stacks.

It has been noticed that it takes a significant amount of time to attach, adjust and, subsequent to use, remove the belt shown in the patent (see, for example, FIGS. 2, 8, 11 and 12). Furthermore, there is often more than the tolerated amount of relative movement between the belt and the person wearing it.

Therefore, there is a need for a pelvic belt that can be quickly and conveniently attached and detached from the pelvic region, and that also firmly mounts to the person's pelvic region.

BRIEF SUMMARY OF THE INVENTION

The invention is a pelvic belt that opens to receive a human's torso near the pelvic region and closes to surround the pelvic region. The pelvic belt firmly retains the pelvic region of the torso, restricting the relative motion of the person's pelvis and the belt. Links made to force resistors, such as weight stacks, cause the motion of the person's pelvic region to be resisted by the weight stacks, thereby strengthening the person's muscles over time.

The belt includes a U-shaped frame having a left frame leg and a right frame leg. The frame has an exterior surface that is circular. A left arm assembly includes an upper left arm pivotably mounted to the left frame leg, and a lower left arm pivotably mounts to the left frame leg below the upper left arm. The lower left arm is rigidly connected to the upper left arm.

A right arm assembly includes an upper right arm pivotably mounted to the right frame leg, and a lower right arm pivotably mounted to the right frame leg below the upper right arm. The upper and lower right arms are rigidly connected.

A left adjustment assembly includes an adjustment wing pivotably mounted to the upper left arm about a substantially vertical axis. A left adjustment rod is pivotably mounted near a first end to the left adjustment wing. The rod extends to insertion of a second end into an aperture in the upper left arm. A right adjustment assembly includes an adjustment wing pivotably mounted to the right arm assembly about a substantially vertical axis. A right adjustment rod pivotably mounts near a first end to the right adjustment wing. The rod extends to insertion of a second end into an aperture in the right arm assembly.

A first releasable lock mounts to the frame near the upper left arm. The releasable lock preferably includes a first finger that removably extends into an aperture formed near an end of the upper left arm. A second releasable lock mounts to the frame near the upper right arm. The releasable lock includes a second finger that removably extends into an aperture formed near an end of the upper right arm.

A hand-grippable handle mounts to the frame and connects to the first and second fingers. The handle is manually actuatable for withdrawing the fingers from the apertures in the upper arms for releasing the arm assemblies to open. The pelvic belt preferably includes an inflatable bladder mounted to an interior surface of the frame.

This structure permits a user to enter the interior region of the pelvic belt when the arm assemblies are open. The user forces his or her body against the inner portions of the arm assemblies, which tends to close the arm assemblies. When the arm assemblies pivot to the closed position, they lock into place, preventing opening during use.

Once in the pelvic belt, the user can adjust the adjustment wings and the inflatable bladder to conform the inner surfaces of the belt to the outer surfaces of his or her pelvic region.

Figure 1:
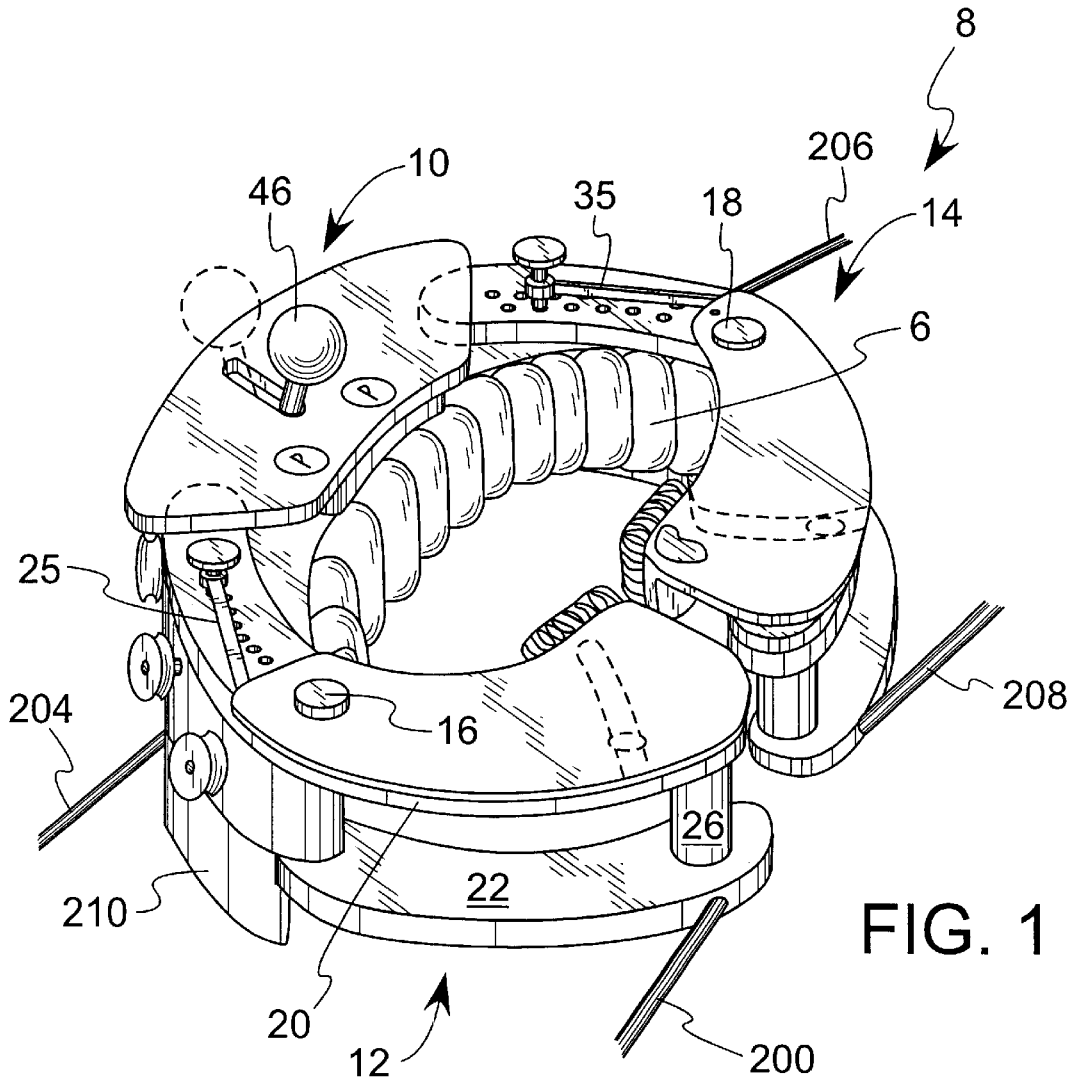
FIG. 1 is a view in perspective illustrating the preferred embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

Figure 2:
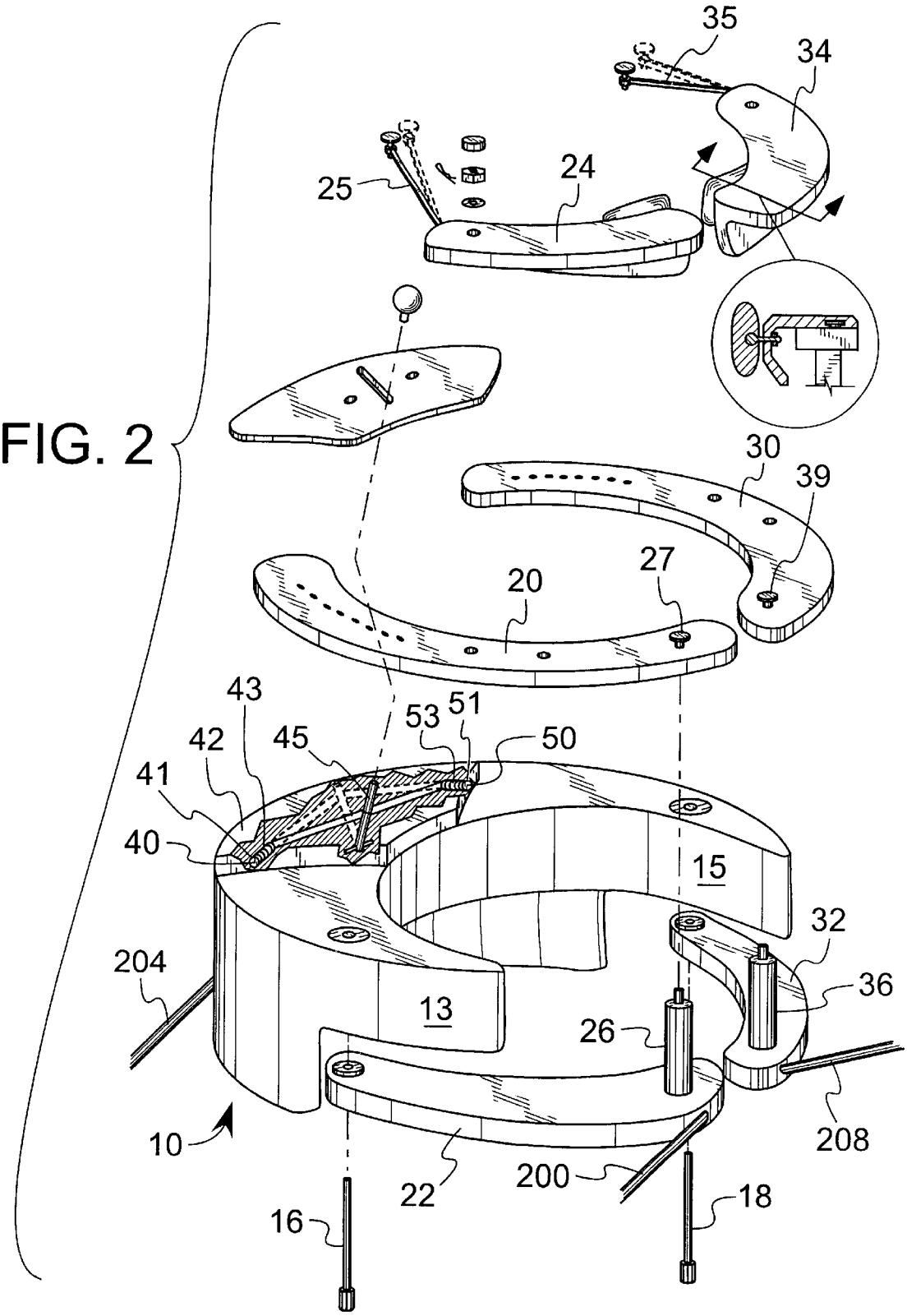
FIG. 2 is an exploded view in perspective illustrating the preferred embodiment of the present invention.

The pelvic belt 8 is shown in FIGS. 1 and 2 having three main components, each of which is made up of other sub-components. The three main components are the U-shaped frame 10, the left arm assembly 12 and the right arm assembly 14.

The frame 10 has left frame leg 13 and right frame leg 15 that extend from a main frame body, and is best viewed in detail in FIG. 2. The left and right arm assemblies are pivotably mounted to the left and right frame legs 13 and 15, respectively, at pivot pins 16 and 18, respectively.

Figure 6:
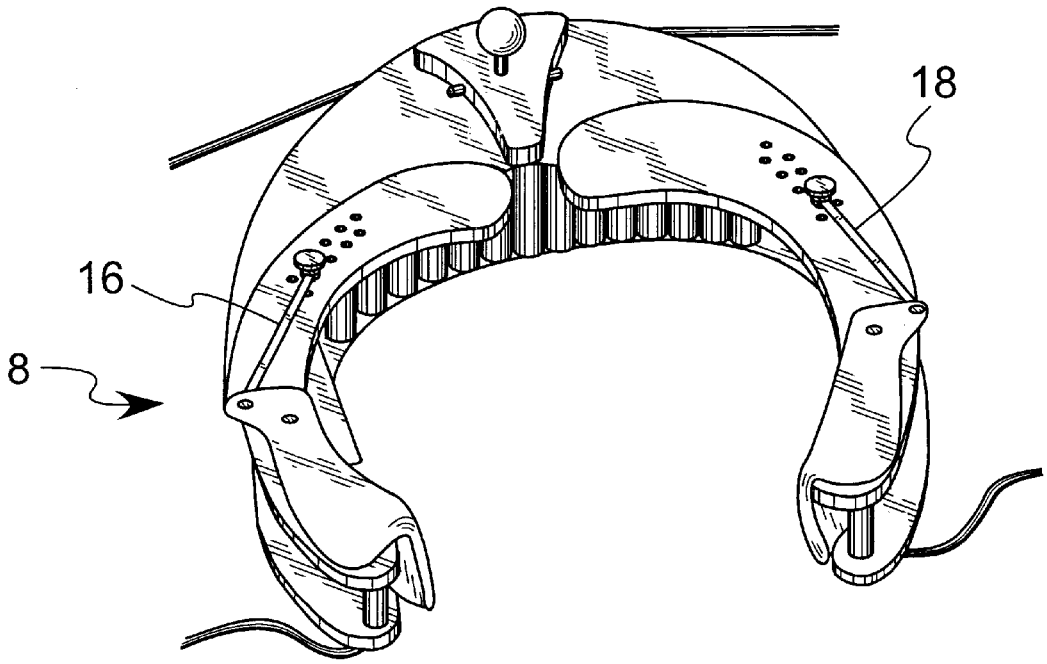
FIG. 6 is a view illustrating the preferred embodiment of the present invention in an open position.

As an introductory summary, when they are closed, the arm assemblies 12 and 14 and the frame 10 form a circular loop with an interior region that is approximately as large as a human pelvis. The arm assemblies pivot relative to the frame to open and permit entry to the interior region of the belt 8. The belt 8 is shown in the open position in FIG. 6. As the person enters the interior of the belt between the arm assemblies, the front part of the person's pelvic region seats against the front of the arm assemblies. As the person progresses into the belt, the pelvis exerts a force against the arm assemblies, tending to pivot them about the pivot pins 16 and 18 toward the closed position shown in FIGS. 1, 7 and 8.

Figure 8:
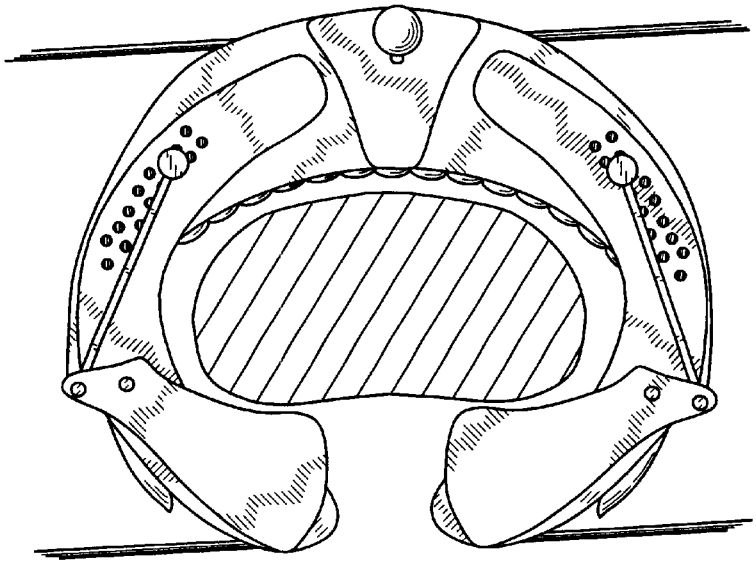
FIG. 8 is a top view along the line 8—8 of FIG. 7.
Figure 7:
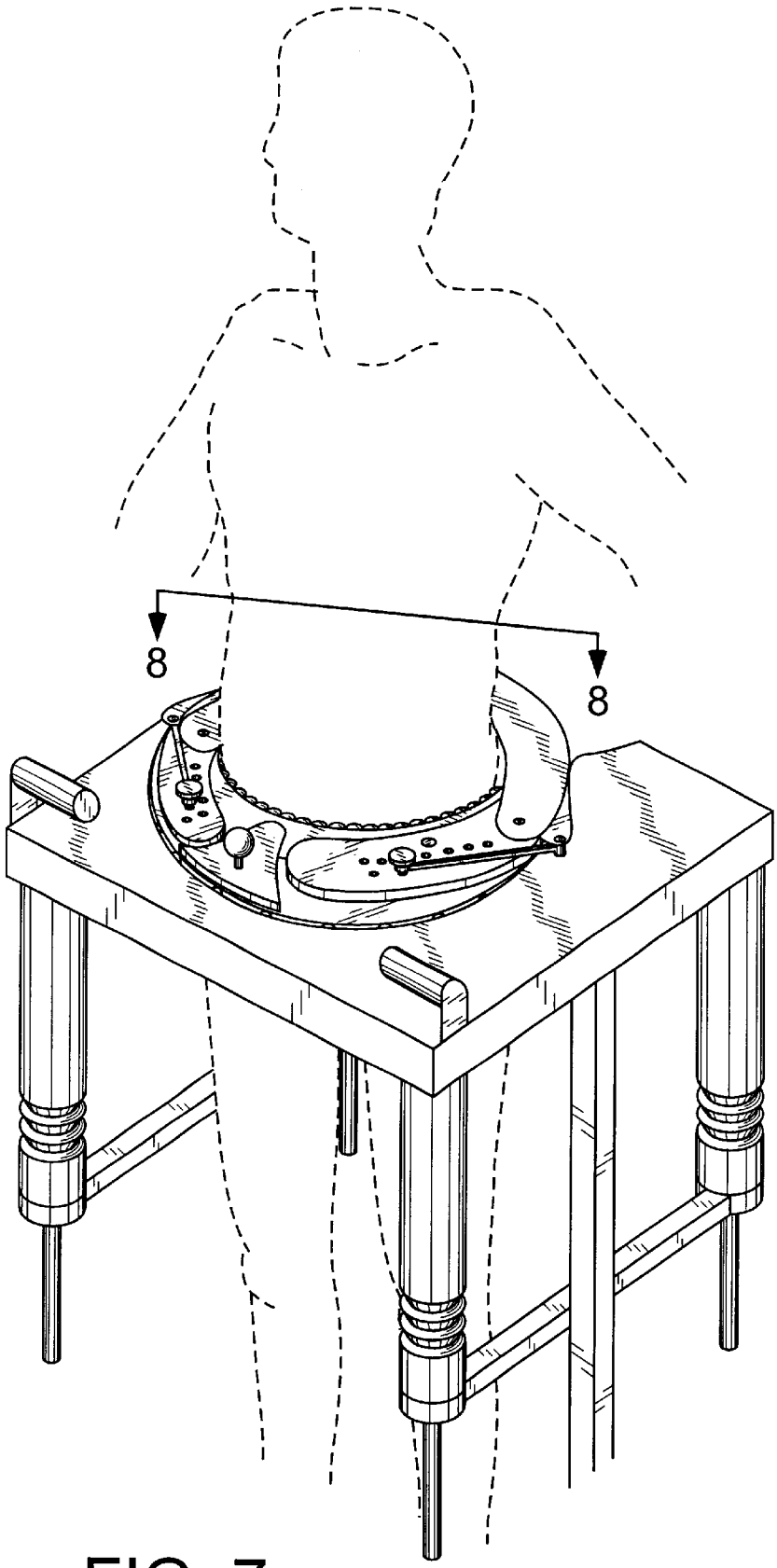
FIG. 7 is a view in perspective illustrating a human user in an operable position in the present invention.

When the arm assemblies are in the closed position as shown in FIG. 1, they lock into place as described below. The inner surfaces of the arm assemblies and the frame firmly seat against the person's pelvic region on all sides as shown in FIGS. 7 and 8, and prevent the person's torso from moving significantly relative to the belt's interior surface. When the pelvic belt is closed around a person's pelvic region and the person rotates his or her torso, the pelvic belt will move with him or her. A weight stack or other resistance mechanism can be drivingly linked to the pelvic belt so that as the pelvic belt moves, the resistance mechanism resists but does not prevent the motion, thereby strengthening the person's muscles over time.

Now, in more detail, each arm assembly 12 and 14 is made up of four sub-components: an upper arm, a lower arm, a connecting rod and an adjustment wing. Referring to FIG. 2, the left arm assembly is made up of the upper left arm 20, the lower left arm 22, the left connecting rod 26 rigidly connecting the upper left arm to the lower left arm and the adjustment wing 24. The right arm assembly includes the upper right arm 30, the lower right arm 32, the right connecting rod 36 rigidly connecting the upper right arm to the lower right arm and the adjustment wing 34.

The combination of the upper left arm, lower left arm and connecting rod 26 forms the rigid backbone of the left arm assembly 12 that pivots about the pivot pin 16 shown in FIGS. 1 and 2. A mirror image of this structure forms the rigid backbone of the right arm assembly 14.

The left and right arm assemblies open and close as described above, and significantly restrict the movement of a person's pelvis relative to the belt. If the belt 8 has been built to match the shape and size of a particular person's pelvis, the left and right arm assemblies alone will substantially restrict the relative motion of the person's pelvis. However, it is contemplated that it will be most desirable to have a pelvic belt that can firmly restrict the relative motion of virtually any expected sized pelvic region, because it will be used by different people with different sized pelvic regions. Therefore, some adjustability is desired to permit tight restraint of virtually any pelvis.

The adjustment wings 24 and 34 permit significant adjustability of the size of the interior region of the pelvic belt. The adjustment wings 24 and 34 are hingingly mounted to the tops of the upper arms 20 and 30, respectively, by the pivot pins 16 and 18 extending through the adjustment wing. One end of each adjustment wing pivots about its pivot pin relative to the rigid backbone of the arm assembly made up of the upper and lower arm and connecting rod. The undersides of the adjustment wings have T-shaped slots into which the retaining pins 27 and 37 extend to maintain the vertical positions of the adjustment wings.

The adjustment wings have an inner plate, preferably with a padded surface. These plates seat against the rear of a user's pelvic region, and swivel and tilt to accommodate different contours.

The elongated adjustment rods 25 and 35 extend from the adjustment wings 24 and 34, respectively, and insert into one of many apertures formed in the surface of the upper arm. The ends of the adjustment rods that mount to the adjustment wings mount pivotably at a point that is offset from the pivot pins 16 and 18. There is therefore a moment arm between the end of the rod and the pivot pin that locks the adjustment wings into position when the opposite ends of the adjustment rods are inserted into the upper arms.

Each different aperture position in the upper arm maintains the adjustment rod, and therefore the adjustment wing and the padded surface, at a different position. The size of the interior region of the pelvic belt is adjusted to closely match the exterior dimensions of the user's pelvic region by selecting an aperture position for each adjustment rod that positions the connected adjustment wing tightly against the person's body. Of course, adjustable hydraulic or pneumatic cylinders or threaded adjustable rods could substitute for the adjustment rods described, as could any equivalent mechanical device known to those of ordinary skill in the art.

An inflatable pad, preferably the pneumatic bladder 6 secured to the interior of the U-shaped frame 10, also adjusts the dimensions of the interior region of the pelvic belt. After the adjustment wings 24 and 34 are positioned as tightly against the user as is practical, the bladder 6 can be inflated to displace any remaining space between the user's pelvis and the U-shaped frame or arm assemblies. The bladder 6 also provides padding between the pelvic belt 8 and the user's body to reduce the possibility of injury.

The arm assemblies of the pelvic belt are maintained in the closed position by releasable locks shown in FIG. 2. The releasable locks preferably include the biased fingers 40 and 50 and the withdrawing cable 44. The left finger 40 protrudes from the aperture 41 formed in the raised plate 42 of the U-shaped frame 10. The left finger is biased out of the aperture by a coil spring 43. The tip of the left finger extends into an aperture formed near, and preferably at, the end of the upper left arm 20 when the upper left arm 20 is in the closed position.

The right finger 50 protrudes from the aperture 51 formed in the raised plate 42. The right finger is biased out of the aperture by the coil spring 53. The tip of the right finger extends into an aperture formed near, and preferably at, the end of the upper right arm 30 when the upper right arm 30 is in the closed position.

When the arm assemblies 12 and 14 are displaced to the closed position, the fingers 40 and 50 extend, under the spring bias, into the apertures on the ends of the upper arms, thereby locking the arm assemblies 12 and 14 in the closed position. Opposite ends of the cable 44 attach to the innermost ends of the fingers 40 and 50. The shaft 45, to which the hand-grippable handle 46 is mounted, seats against an intermediate region of the cable. The shaft 45 is pivotable about a hinged lower end, and when pivoted causes the portion of the shaft 45 that seats against the cable 44 to displace the central region of the cable.

When it is desired to open the pelvic belt 8, the shaft 45 is manually pivoted by displacing the handle 46. The central region of the cable 44 is thereby displaced, displacing the opposite cable ends inwardly. When displaced a sufficient distance, the inwardly displaced cable 44 pulls the fingers 40 and 50 out of the apertures in the upper arms 20 and 30. When the fingers are withdrawn from the apertures in the upper arms, the arm assemblies 12 and 14 are free to pivot about the pivot pins 16 and 18 to an open position. Rearward pressure by the pelvic belt wearer will pivot the arm assemblies.

Figure 3:
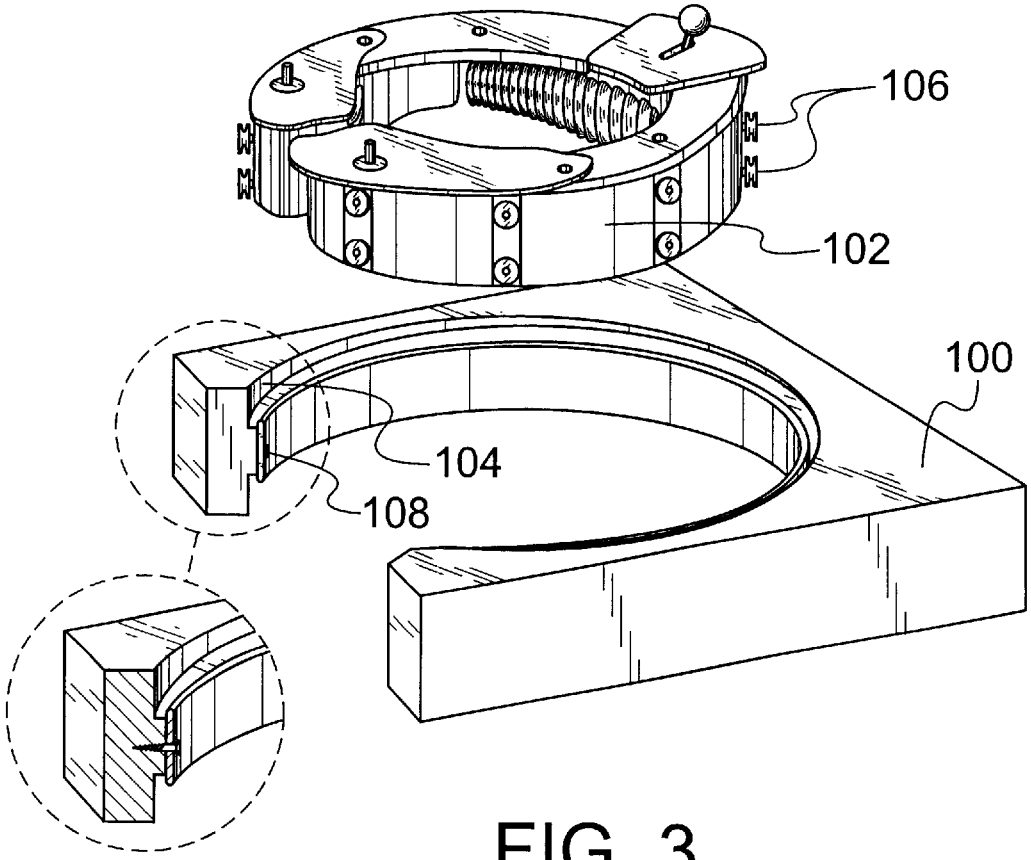
FIG. 3 is an exploded view in perspective illustrating the preferred embodiment of the present invention.

The U-shaped frame 10 of the pelvic belt 8 mounts to a stationary platform 100 shown in FIG. 3. An outer surface 102 of the frame 10 mounts adjacent an inner surface 104 of the platform, and both surfaces 102 and 104 are circular. The circular shapes of the adjacent surfaces permit rotation of the pelvic belt 8 relative to the platform 100 without interference.

Figure 4:
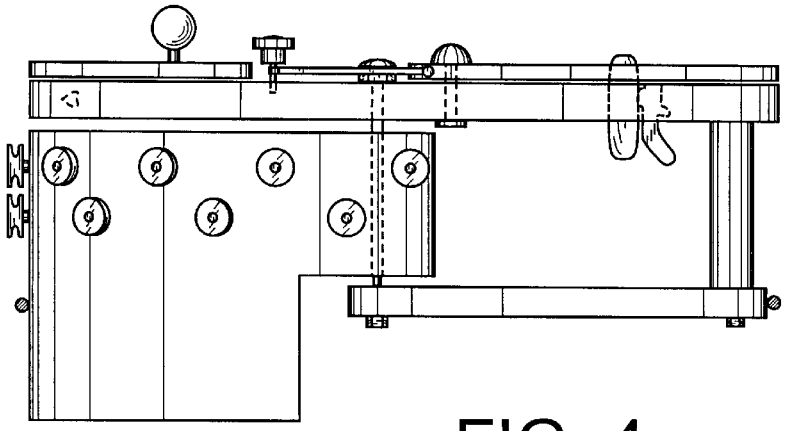
FIG. 4 is a side view illustrating the embodiment shown in FIG. 1.
Figure 5:
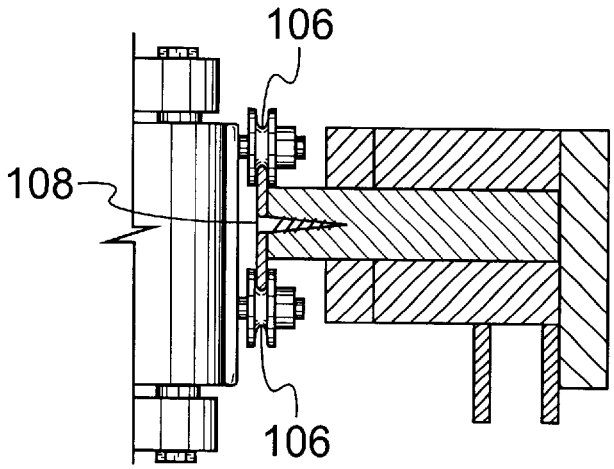
FIG. 5 is a side view in section illustrating the pelvic belt in position in the platform.

The frame 10 has pulleys 106 mounted to the outer surface 102 on opposite sides of a path, as shown in FIGS. 3 and 4. A curved track, preferably a tube 108 or rigid strip, is mounted to the inner surface 104 and inserted in the path between the pulleys 106 as shown in FIG. 5. The pulleys 106 seat against opposite sides of the tube 108, retaining the tube within the path, when the pelvic belt 8 is in its operable position mounted to the platform 100.

As the pelvic belt is displaced in rotation by the user's pelvic region, the pulleys ride above and below the tube, restraining the pelvic belt's degrees of freedom to that of rotation. The length of the tube 108 is preferably approximately two-thirds of the circumference of the pelvic belt 8.

As shown in FIGS. 1 and 2, cables 200, 204, 206 and 208 may be mounted to the frame 10 and arm assemblies 12 and 14. The cable 200 mounts to the lower arm 22 of the left arm assembly 12, permitting a single force resistor to be attached to the left arm assembly. The cable 204 mounts to the central region of the frame 10 (connection not shown), permitting a single force resistor to be attached to the frame from the left side. Cables 206 and 208 mount similarly to the frame 10 and right arm assembly 14, respectively, permitting separate single force resistors to be attached to the frame from the right side and the right arm assembly 14.

The frame 10 has a lower cable shield 210 section that keeps the cables 204 and 206 from bearing against the user of the pelvic belt 8. Instead, as the pelvic belt is rotated by the user, the cables bears against the outer surface of the cable shield 210.

An advantage of the pelvic belt 8 is that it restrains the pelvic region so well, it can hold the ilial bones in place during use.

The contemplated dimensions of the pelvic belt 8 are as follows: internal width—20 inches; internal depth (front to back)—8 inches for children, 10.5 inches for adults; outside diameter—24 inches; walk-in clearance side to side—18 inches; minimum internal width—15 inches. Of course, these dimensions could be changed.

From the centered position, the pelvic belt 8 should be permitted to rotate only a maximum of about 120 degrees in each direction, because a normal rotation is about 90 degrees or less to each side. The extreme of rotation can be controlled through mechanical limiters, such as brakes or stops, and electronic devices, such as electromagnets to reduce the likelihood of injury.

While certain preferred embodiments of the present invention have been disclosed in detail, it is to be understood that various modifications may be adopted without departing from the spirit of the invention or scope of the following claims.

What is claimed is:

1. A pelvic belt that opens to receive a human's torso near the pelvic region and closes to surround the torso, the belt comprising:

(a) a U-shaped frame having a left frame leg and a right frame leg, said frame having an exterior surface that is circular;

(b) a left arm assembly including an upper left arm pivotably mounted to the left frame leg and a lower left arm pivotably mounted to the left frame leg below the upper left arm, and rigidly connected to the upper left arm;

(c) a right arm assembly including an upper right arm pivotably mounted to the right frame leg and a lower right arm pivotably mounted to the right frame leg below the upper right arm, and rigidly connected to the upper right arm;

(d) a left adjustment assembly including an adjustment wing pivotably mounted to the upper left arm about a substantially vertical axis, and a left adjustment rod pivotably mounted near a first end to the left adjustment wing, the rod extending therefrom to insertion of a second end into an aperture in the upper left arm;

(e) a right adjustment assembly including an adjustment wing pivotably mounted to the right arm assembly about a substantially vertical axis, and a right adjustment rod pivotably mounted near a first end to the right adjustment wing, the rod extending therefrom to insertion of a second end into an aperture in the right arm assembly;

(f) a first releasable lock mounted to the frame near the upper left arm, said releasable lock including a first finger that removably extends into an aperture formed near an end of the upper left arm;

(g) a second releasable lock mounted to the frame near the upper right arm, said releasable lock including a second finger that removably extends into an aperture formed near an end of the upper right arm;

(h) a hand-grippable handle mounted to the frame and connected to the first and second fingers, the handle being manually actuatable for withdrawing the fingers from the apertures in the upper arms for releasing the arm assemblies to open; and (i) an inflatable bladder mounted to an interior surface of the frame.

2. The pelvic belt in accordance with claim 1, further comprising:

(a) multiple pulleys rotatably mounted to the circular, exterior surface of the frame;

(b) a platform receptacle having a circular interior surface that receives the circular exterior surface of the U-shaped frame; and (c) a curved rod mounted to the circular interior surface of the U-shaped platform and interposed between pairs of the pulleys mounted to the exterior surface of the U-shaped frame;

wherein four cables attach to the pelvic belt, a first cable mounts to the left arm assembly, a second cable mounts to the right arm assembly, and a third and fourth cable mounts to the U-shaped frame.

* * * * *